United States Patent [19]

Sussman

[11] 4,093,165

[45] June 6, 1978

[54] DEVICE FOR HOLDING BABY BOTTLES

[76] Inventor: Edward Sussman, 166-25 Powells Cove Blvd., Beechhurst, Queens, N.Y. 11415

[21] Appl. No.: 762,882

[22] Filed: Jan. 27, 1977

[51] Int. Cl.[2] ..... A47D 15/00

[52] U.S. Cl. ..... 248/106; 248/206 R

[58] Field of Search ..... 248/102–107, 248/206 R, 418; 403/116

[56] References Cited

U.S. PATENT DOCUMENTS

| | | | |
|---|---|---|---|
| 442,585 | 12/1890 | Von Huppmann-Valbella | 248/103 |
| 601,732 | 4/1898 | McCollom | 248/104 |
| 956,749 | 5/1910 | Allen | 248/103 |
| 2,040,757 | 5/1936 | Murphy | 248/103 |
| 2,063,554 | 12/1936 | Meyerson | 248/106 |
| 2,133,923 | 10/1938 | Perlmutter | 403/116 X |
| 2,366,931 | 1/1945 | Plain | 248/105 |
| 2,386,042 | 10/1945 | Elzeer | 248/106 |
| 2,469,859 | 5/1949 | Charbeneau | 248/106 |
| 2,558,978 | 7/1951 | Pettit | 248/106 |
| 2,912,200 | 11/1959 | Reinhorn | 248/107 |

FOREIGN PATENT DOCUMENTS

| | | | |
|---|---|---|---|
| 32,565 | 4/1912 | Sweden | 248/103 |

*Primary Examiner*—Lawrence J. Staab
*Attorney, Agent, or Firm*—Gottlieb, Rackman & Reisman

[57] ABSTRACT

A device for holding baby bottles on an upward slant so that a baby sitting in a highchair or the like may drink from such a baby bottle at his will. The device includes a cage for removably retaining the bottle at an erect angle, a suction cup adapted to grip any flat surface and a swivel mechanism for rotatably joining the bottle cage to the suction cup. The swivel mechanism has limit means to pemit the cage to rotate about a vertical axis relatively freely through an arc in the range of 180°, so that the cage and the bottle in the cage may be swung away from the baby when desired, as for example when the baby is being given food by means of a spoon.

1 Claim, 5 Drawing Figures

DEVICE FOR HOLDING BABY BOTTLES

The present invention relates to a device for holding baby bottles, and especially to such a device for holding baby bottles in an erect orientation on an upward slant so that a baby sitting in a baby chair may drink from such a bottle at will.

It is the primary object of the present invention to provide a device for holding baby bottles in an erect position so that a baby sitting in a baby chair may drink at will from such a bottle and may at other times be free to eat food presented to it as by a spoon.

It is a further object of the present invention to provide a device for holding baby bottles of the character described, wherein the device may rotate about a vertical axis through an arc in the range of 180°, so that a mother or other person attending a baby presented with such a device, may swing the device and the bottle in it away from the baby, so that the mother may feed the baby as by way of food on a spoon.

It is still a further object of the present invention to provide a device for holding baby bottles of the character described, wherein the device is configured so that the mother can readily determine the amount of milk or other liquid in the baby bottle in order to ascertain whether the bottle is empty.

It is still a further object of the present invention to provide a device for holding baby bottles of the character described, wherein the device is welladapted to be used with a baby bottle having a sucking straw inside it.

Prior art devices for holding baby bottles can in general be characterized as being complex in structure and in the number of parts required for their proper operation, as not being formed so as to enable a person to readily observe the quantity of milk or other fluid in such bottle, and as being substantially rigid, although some such prior art devices can be rotated with the application of substantial force. The present invention presents a device for holding baby bottles which is well-adapted to be used with a baby bottle having a sucking straw in it due to the fact that it holds such a baby bottle erectly along an upward slant. The device is formed so that the contents of the bottle may be readily and continuously observed. The device further includes a swivel mechanism so that with a minimum of effort, the baby bottle can be swung from a position in which the baby can readily suck at the bottle's nipple to a position wherein it is distant from the baby's head, so that the baby can be fed with food as by means of a spoon.

In general, the present device includes a cage for removably receiving a baby bottle. The cage is oriented so that the central axis of the bottle lies along an upward slant. The cage includes a collar encircling the girth of the bottle and a rod, fixed to the collar, surrounding the end of the bottle. The device also includes a suction cup adapted to grip any flat horizontal surface, as for example the shelf of a baby's highchair.

A swivel mechanism rotatably joins the cage to the suction cup and enables rotation of the cage through an arc in the range of 180°. The swivel mechanism includes upper and lower bearing members joined by a vertically oriented pin. An arcuate slot in one of the members and a stud carried by the other member, riding in the slot, serve to limit rotative movement of the cage to the arc mentioned.

Further objects, features and advantages of this invention will become more readily apparent from an examination of the following specification, when taken in conjunction with the accompanying drawings wherein.

Figure 3:
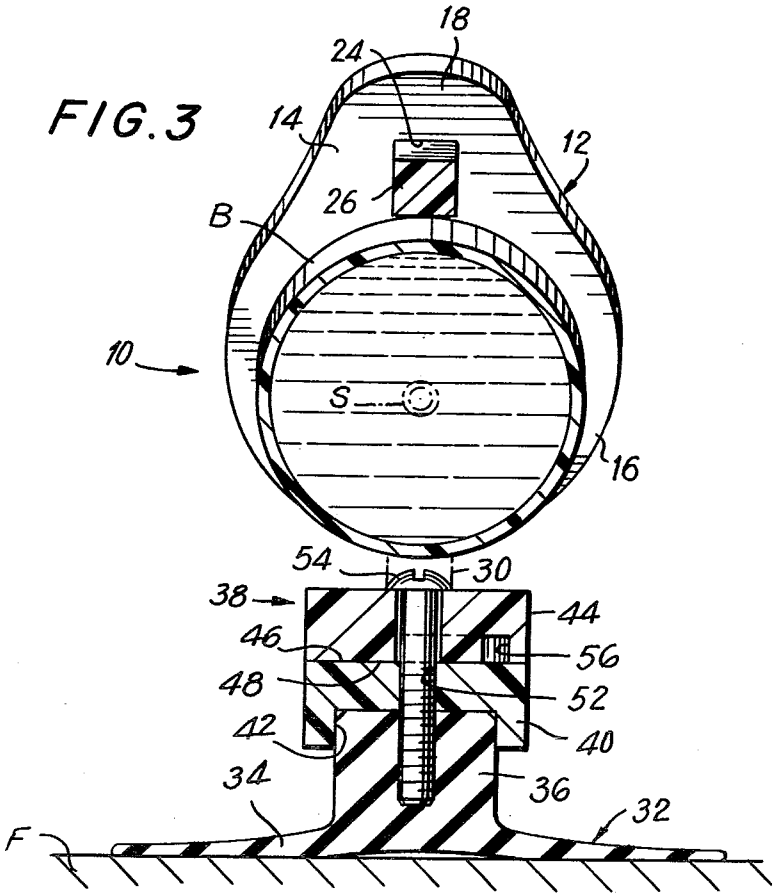
FIG. 3 is an enlarged cross-sectional view, taken substantially along the line 3—3 of FIG. 2.
Figure 1:
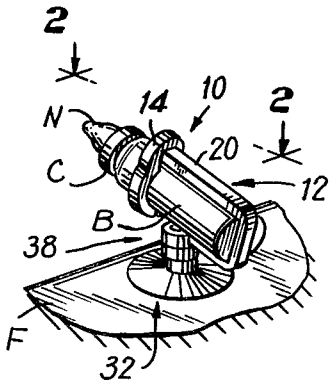
FIG. 1 is a perspective view of the device for holding baby bottles, showing the same mounted on a flat surface such as the shelf of a highchair.
Figure 2:
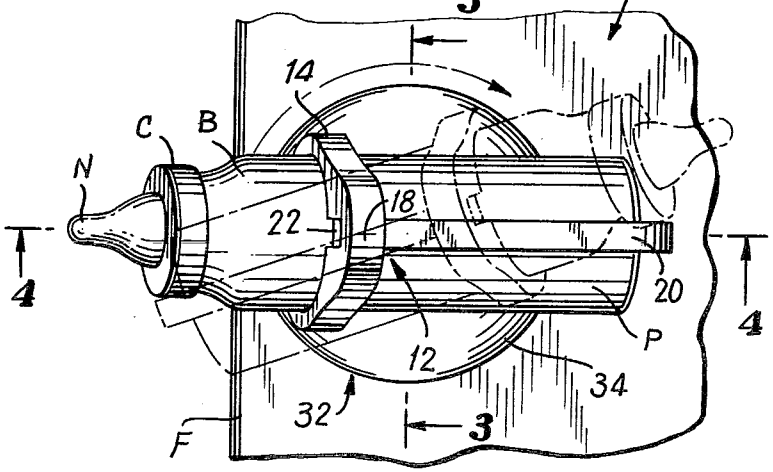
FIG. 2 is a top view of the device for holding baby bottles, taken substantially along the line 2—2 of FIG. 1, and showing in dot and dash lines, the position to which the baby bottle may be rotated by the device.

Referring now to the drawings, and especially FIGS. 1–3, there is shown and designated as reference numeral 10, a device for holding baby bottles in a substantially erect position. The device 10 is intended to operate with most "standard" baby bottles. Such a bottle B conventionally includes a bottle portion P, a nipple N, a cap C joining the nipple N to the bottle portion P, and an internally-extending sucking straw S. The bottle portion P, is most usually transparent so that milk or other fluids in the bottle portion P are visible. The sucking straw S extends from the nipple N well towards the bottom of the bottle portion P, and enables a baby of tender years to suck on the nipple to draw up fluid from within the bottle portion P by normal sucking action.

The device 10 includes a bottle cage 12 which is adapted to releasably retain a bottle B of standard size and configuration. The cage 12 of the device 10 includes an annular collar 14 having an encircling ring 16 and a yoke 18, the interior diameter of the ring 16 being only slightly larger than the outside diameter of the bottle portion P so that there is some slight friction between the ring and the outside of the bottle, yet the bottle can be placed into and withdrawn from the cage without difficulty by the mother or other person attending the baby. However, the frictional fit is sufficient to prevent the infant from removing the bottle from the cage.

Figures 4, 5:
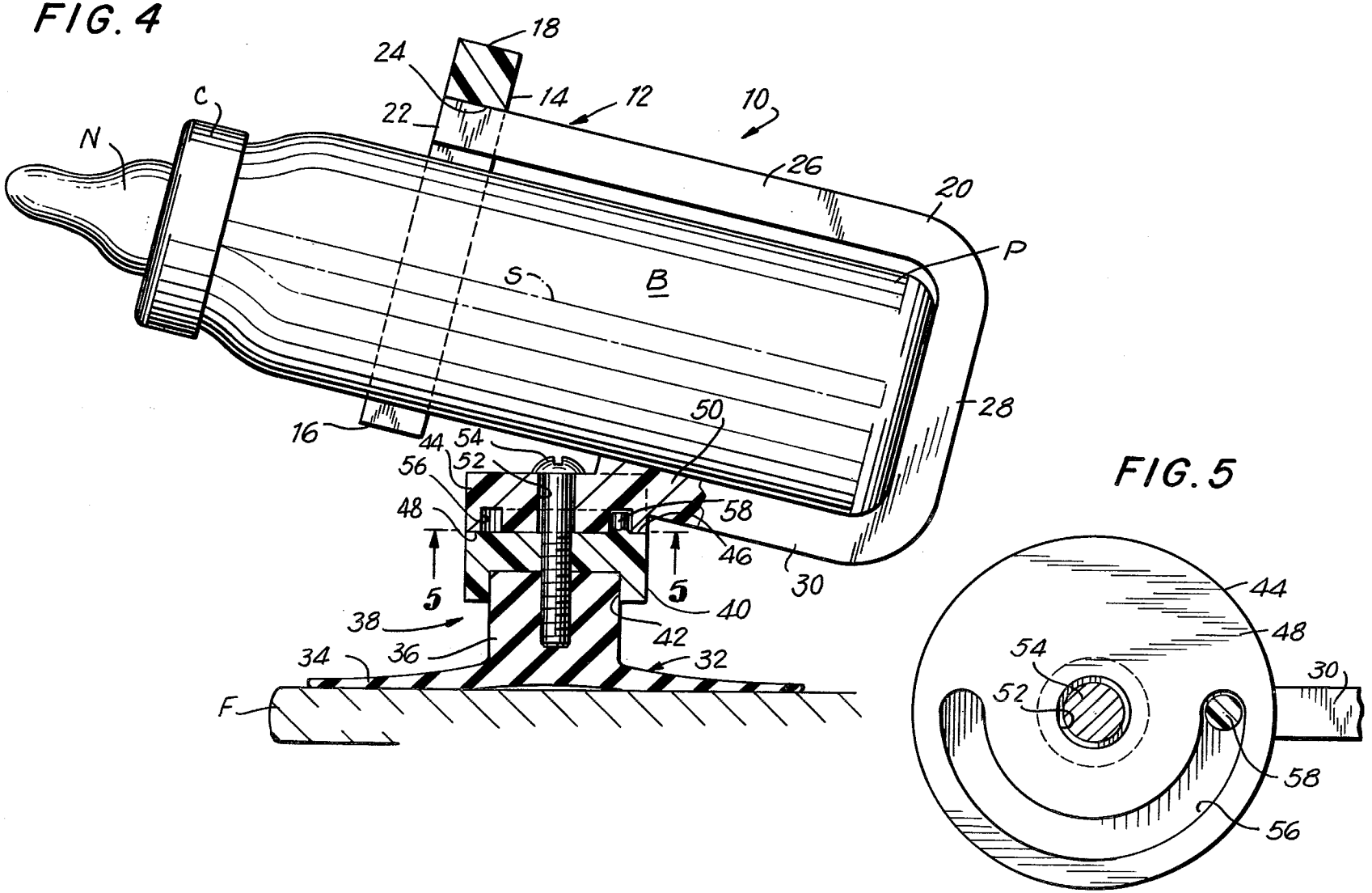
FIG. 4 is an enlarged side elevational and partially cross-sectional view, taken substantially along the line 4—4 of FIG. 2.
FIG. 5 is an enlarged bottom plan and partially cross-sectional view of the swivel mechanism, taken substantially along the line 5—5 of FIG. 4.

The cage 12 further includes an elongated rod 20 of an overall "J" configuration. As best seen in FIG. 4, the rod 20 includes an end 22 passing through a slot 24 in the yoke 18, and joined at that location to the yoke 18 as by an appropriate adhesive. The rod 20 continues from its end 22 along a leg 26 parallel to the sucking straw S, then along an intermediate leg 28 generally perpendicular to the leg 26 and generally parallel to the bottom floor of the bottle portion P, and then along a leg 30 perpendicular to the intermediate leg 28 and parallel to, but shorter than, the leg 26. The rod surrounds the end of the bottle, while the collar encircles the girth of the bottle.

It will be seen that the baby bottle B, and specifically the bottle portion P, can be slipped through the large-diameter opening within the ring 16 of the collar 14 and can be brought to a position in which the bottom of the bottle portion P rests against the interior face of the intermediate leg 28. When in this location, the bottle B is held at an erect angle so that the nipple N is oriented upwardly towards the face of a baby sitting in a baby chair, and the bottle portion P is itself retained by both the collar 14 and the rod 20 which make up the cage 12 along an upward slant in the range of 15° with the horizontal, with such measurement being taken along the central axis of the bottle B.

The components of the cage 12, namely the collar 14 and the rod 20, are preferably fabricated of a heavy, rigid plastic material which is relatively lightweight, sanitary and of a modern appearance. Since the cage components are relatively narrow members, the contents of the bottle can be readily observed as by a mother attending the baby who is drinking from the bottle in the device.

The device 10 includes a suction cup 32 of a heavy-duty type, and of conventional design. The suction cup 32 includes a cup portion 34 and a central upstanding stem 36. The suction cup 32 is adapted to be joined to, i.e., grip any flat horizontal surface, such as for example, shelf F of a baby chair.

A swivel mechanism, generally designated 38, attaches the cage 12 to the suction cup 32 for rotation about a substantially vertical axis, when the suction cup 32 is attached to a horizontal surface such as the shelf F. To this end, the swivel mechanism 38 includes a lower bearing member or base 40, circular in plan. This bearing member has a recess 42 in its lower face in which the upper portion of the stem 36 is fixedly received, as by the use of an appropriate adhesive.

The swivel mechanism 38 further includes an upper bearing member 44 having an outside diameter substantially identical to the outside diameter of the base 40, with the upper face 46 of the base 40 being in frictional contact with the lower face 48 of the upper bearing member 44. The bottle cage 12 is joined to the swivel mechanism 38 by means of the leg 30 being integral with and extending from the upper bearing member 44 at juncture 50, as shown most clearly in FIG. 4.

In general, the orientation of the leg 30 to the upper bearing member 44 determines the upward slant of the bottle. However, it will be seen that the upward slant of the bottle may be temporarily varied slightly by a baby by use of his mouth, as a result of the inherent flexibility of suction cup 32. Thus, the infant may draw the nipple N either slightly upward or slightly downward to the position which is most comfortable during sucking. When this sucking is completed, the cage returns to its original slant.

Referring now, in addition to FIG. 5, both the upper bearing member 44 and the base 40 have vertical coaxial bores 52 centrally located in them, and a headed bolt or pin 54 passes through these bores and is fixed centrally in the stem 36 of the suction cup 32. The diameter of the bore 52 in the upper bearing member 44 is slightly larger than the diameter of the bolt 54, enabling this bearing member to rotate about the bolt and over the base 40. The axis of rotation of the swivel mechanism thus passes centrally through the bolt 54.

As a result of the foregoing structure, the cage 12 and any bottle in the cage 12 can swing quite freely about a vertical axis so as to bring the nipple N of the baby bottle B from a location somewhat adjacent to the head of a baby sitting in a highchair on a shelf of which the device 10 is mounted, to a position distant from the baby's head. The first-mentioned position is shown in full lines in FIG. 2, while the second position is shown in dot and dash lines in the same figure.

Stop means is provided to limit the arc of movement of the cage to desirably one of about 180°. Specifically, the lower face 48 of the upper bearing member 44 has an arcuate slot 56, best shown in FIG. 5, formed in it. The slot itself describes an arc of about 180°. A stud 58 which rises from the upper face 46 of the base 40 protrudes into and rides in the slot. Hence, as the upper bearing member 44 rotates, the stud 58 will in due course strike one end of the slot 56, thereby preventing further rotative movement of the upper bearing member 44 and the cage 12. Rotation of the cage 12 and the upper bearing member 44 in the opposed direction is permitted to continue until the stud 58 strikes the other end of the slot 56, halting further movement.

It has been found desirable to impart to the swivel mechanism 38 the capability of swinging through an arc of approximately 180°, so that when desired the nipple N of the baby bottle B can be presented to a baby sitting in a highchair and than can be swung away from the baby, as when the mother of the baby desires to feed the baby by means of a spoon.

It will be appreciated that the present baby bottle device enables a baby to suck at its bottle, without the need of the mother continually holding the bottle. The device holds the bottle erectly so that the baby can suck its nipple with ease. The device is configured to permit continuous viewing of the bottle contents. The swivel mechanism enables the bottle to be swung by the mother away from the baby when the baby is to be fed by spoon and to again be swung toward the baby when bottle feeding is to be resumed.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention, as set forth in the appended claims.

I claim:

1. A device for holding a baby bottle, especially a bottle of the type containing an internal sucking straw, the device comprising a flexible suction cup adapted to grip any flat horizontal surface, a collar encircling the bottle about its circumference, a rod fixed to the collar and encircling the bottle about its lower length, the collar and the rod forming a bottle cage removably retaining the bottle, a swivel mechanism comprising upper and lower bearing members, the rod being fixed to the upper bearing member so as to orient the rod and thereby the cage along an upward slant in the range of 15° to the horizontal, and the suction cup being fixed to the lower bearing member, the flexibility of the suction cup enabling limited manual variation of the upward slant of the cage, and a substantially vertically-oriented pin member passing through and joining the bearing members for rotation about a substantially vertical axis, the lower bearing member carrying a stud and the upper bearing member having an arcuate slot extending through an arc in the range of 180° for receiving the stud, thereby limiting the rotation of one bearing member with respect to the other bearing member.

* * * * *